US006073317A

United States Patent [19]

Barison

[11] Patent Number: 6,073,317

[45] Date of Patent: Jun. 13, 2000

[54] LANYARD BREAKAWAY CONNECTOR

[76] Inventor: Joseph I. Barison, P.O. Box 9650, Denver, Colo. 80209

[21] Appl. No.: 09/136,780

[22] Filed: Aug. 19, 1998

Related U.S. Application Data

[60] Provisional application No. 60/056,450, Aug. 19, 1997.

[51] Int. Cl.[7] ..... A44B 11/25

[52] U.S. Cl. ..... 24/115 F; 24/575

[58] Field of Search ..... 24/575–578, 604, 24/662, 664, 697.1, 573.1, 633, 634, 580, 629, 625, 614–616, 115 F, 115 M, 602, 598.4, 265 EC, 265 BC; 63/3.1, 15.2

[56] References Cited

U.S. PATENT DOCUMENTS

| | | | |
|---|---|---|---|
| 870,617 | 11/1907 | Falter | 24/575 |
| 1,024,566 | 4/1912 | Gifford | 24/575 |
| 3,520,033 | 7/1970 | Usuda | 24/575 |
| 3,979,801 | 9/1976 | Tareau | 24/575 |
| 5,224,247 | 7/1993 | Collier | 24/575 X |
| 5,533,238 | 7/1996 | Say | 24/115 F |
| 5,669,119 | 9/1997 | Seron | 24/129 R |

*Primary Examiner*—Anthony Knight
*Assistant Examiner*—Robert J. Sandy
*Attorney, Agent, or Firm*—Edwin H. Crabtree; Ramon L. Pizavvo; Donald W. Margolis

[57] ABSTRACT

A lanyard breakaway connector used for mounting on opposite ends of a lanyard. The lanyard is received around a neck of a user. The breakaway connector is used for releasably securing together opposite ends of the lanyard. When the ends of the lanyard are placed in tension, the connector quickly releases thus preventing injury to the user. The breakaway connector includes a first connector member and a second connector member. The two connector members are identical in structure. The first member includes a first housing and the second member includes a second housing. The first and second housings include spikes therein for engaging and holding the opposite ends of the lanyard. Extending outwardly from an opposite end of the first housing is a first ball arm with a first ball mounted thereon and a parallel first socket arm with channel and hole therein. Extending outwardly from an opposite end of the second housing is a second ball arm with a second ball mounted thereon and a parallel second socket arm with channel and hole therein. When connecting the two connector members, the first ball arm is received in the channel of said second socket arm and the second ball arm is received in the channel of the first socket arm. The first and second ball may be made of different sizes to increase or decrease the amount of friction required in disengaging the two connector members when tension is applied to the lanyard.

8 Claims, 1 Drawing Sheet

LANYARD BREAKAWAY CONNECTOR

This application claims the benefit of U.S. Provisional Application No. 60/056,450, filed Aug. 19, 1999.

BACKGROUND OF THE INVENTION (a) Field of the Invention

This invention relates to connectors for neckwear and the like and more particularly, but not by way of limitation, to a breakaway connector used for engaging opposite ends of a lanyard.

(b) Discussion of Prior Art

Heretofore there have been a variety of different types of breakaway connectors used with safety pull cords for window dressings, breakaway connectors for necklaces, breakaway ID badge lanyards and safety cord devices.

In U.S. Pat. No. 5,533,238 to Say, a breakaway cord connector is described for use with drawstrings, ski pass holders and eyewear retainers. This patent describes a complex pair of identical cord connectors with a self-mating, tongue-in-groove design used in securing opposite ends of a cord.

U.S. Pat. Nos. 4,477,947 to Lyons, 4,944,074 to Bullat et al. and 4,909,298 to Langhart et al., disclose different types of safety cord releases and safety pull cords for window shades.

In U.S. Pat. No. 5,027,477 to Seron, a breakaway necklace is described. A female clip is used with engaging fingers for quick release when tension is applied to the necklace.

None of the above-mentioned patents and prior art cord connectors incorporate the unique combination of structure and function of the subject lanyard breakaway connector as described herein.

SUMMARY OF THE INVENTION

In view of the foregoing, it is a primary object of the present invention to provide a lanyard breakaway connector that will disengage quickly with a minimum amount of tension placed on a lanyard to protect the neck of the user of the lanyard.

Another object of the invention is that it is inexpensive, lightweight and easily mounted on opposite ends of a lanyard.

Still another object of the novel connector is the lanyard breakaway connector includes a pair of connector members which are identical and interchangeable for ease in installation and reducing the amount of inventory of parts required.

A further object of the invention is the breakaway connector may be used with different types of lanyards and a variety of various types of cords and chains used around a neck of a user. The neckwear using the connector may be used for holding badges, identification cards, medallions, passes, jewelry and other items displayed around the neck or resting on the chest of the user.

The lanyard breakaway connector includes a first connector member and a second connector member. The two connector members are identical in structure. The first member includes a first housing and the second member includes a second housing. Each housing includes spikes therein for engaging and holding the opposite ends of the lanyard. Extending outwardly from an opposite end of the first housing is a first ball arm with a first ball mounted thereon and a parallel first socket arm with channel and hole therein. Extending outwardly from an opposite end of the second housing is a second ball arm with a second ball mounted thereon and a parallel second socket arm with channel and a hole therein. When connecting the two connector members, the first ball arm is received in the channel in the second socket arm. Also, the second ball arm is received in the channel of the first socket arm. The first and second ball may have different diameters to increase or decrease the amount of friction required in disengaging the two connector members when tension is applied to the lanyard.

These and other objects of the present invention will become apparent to those familiar with the different types lanyards and related breakaway connectors when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
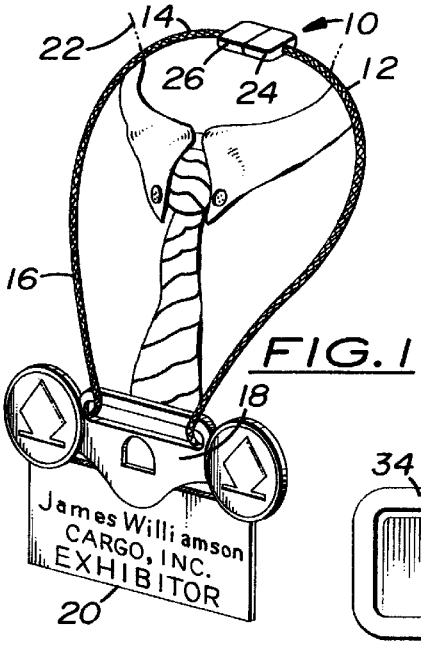
FIG. 1 is a perspective view of the subject lanyard breakaway connector attached to opposite ends of a lanyard. The lanyard is shown received around a neck of a user and displaying an identification badge at a trade show.

In FIG. 1, a perspective view of the subject breakaway connector is shown having a general reference numeral 10. The connector 10 is shown attached to one end 12 and an opposite end 14 of a lanyard 16. The lanyard 16 is shown attached to a card holder 18 holding an identification card 20 with trade show information thereon. The card holder 18 and identification card 20 with trade show information form no part of the invention and are shown as an example of various items with information that are suspended on the lanyard 16.

Also shown in this drawing is the lanyard 16 received around a neck 22 of a user of the invention. The neck 22 is shown in dotted lines.

Broadly, the breakaway connector 10 includes a first connector member 24 releasably attached to a second connector member 26. The two connector members 24 and 26 are identical and interchangeable for ease in inventory control. Also, the connector 10 requires the molding of only one part rather than making separate parts. The two connector members may be made from various types of plastic.

Figure 2:
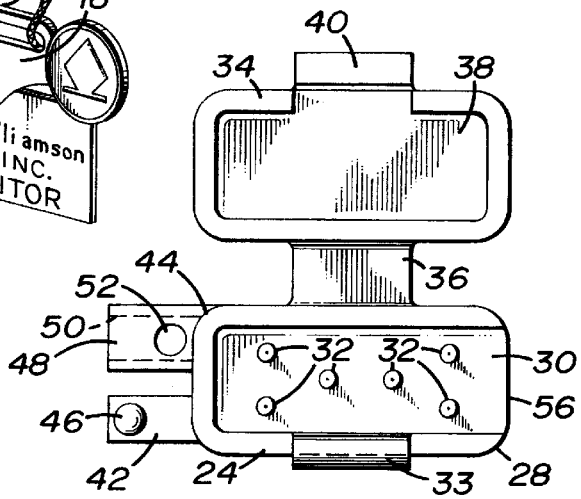
FIG. 2 is a top view on a first connector member shown in an open position. The first connector shown in FIGS. 2–5 and 8 has been enlarged for illustrating greater detail of the invention.

In FIG. 2, a top view of the first connector member 24 is shown and disposed in a open position. While the first connector member 24 is discussed in detail herein, it should be kept in mind that the two connector members 24 and 26 are identical in structure and function. The first connector member 24 includes a housing 28 with an elongated groove 30 therein. Spaced along a length of the groove 30 are a plurality of upwardly extending spikes 32. Centered along one side of the housing is an elongated pawl 33. A housing cover 34 is attached to the housing 28 using a foldable hinge 36. The housing cover 34 is dimensioned to cover the top of the housing 28 and includes a recess 38 therein. The housing cover 34 includes a latch 40 with is used to engage the pawl 33 when the housing cover 34 is folded in a closed position on top of the housing 28.

A first ball arm 42 extends outwardly from one end 44 of the housing 28. The first ball arm 42 includes a first ball 46 mounted on the end thereof. Also, a first socket arm 48 extends outwardly from the end 44 of the housing 28. The first socket arm 48 is parallel to the first ball arm 42 and includes a channel 50 therein and a hole 52 for releasably receiving a ball therein. The channel 50 is shown in dotted lines.

Figure 3:
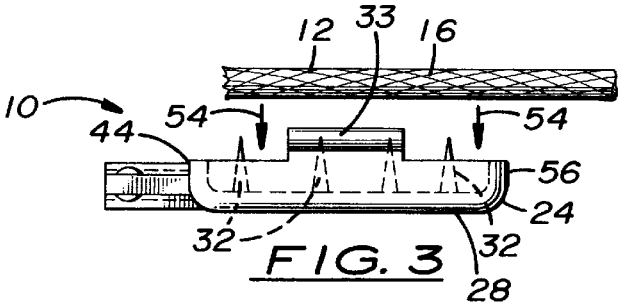
FIG. 3 is a side view of the first connector member shown in FIG. 2 and positioned for receiving an end of the lanyard therein.

In FIG. 3, a side view of the first connector member 24 is shown. In this drawing the end 12 of the lanyard 16 is shown positioned above the groove 30 in the housing 28. In operation, the end 12 of the lanyard 16 is lowered, as indicated by arrows 54 on top of the spikes 32 and pressed into the spikes 32 for holding the lanyard 16 inside the housing 28. The lanyard 16 extends outwardly from an opposite end 56 of the housing 28 when the lanyard is secured therein.

Figure 4:
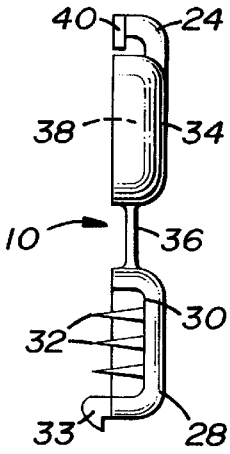
FIG. 4 is an end view of the first connector member shown in FIG. 2 and with the housing in an open position.

In FIG. 4, an end view of the first connector member 24 is shown in an open position as seen in FIG. 2. In this view, the spikes 32 can be seen extending upwardly from the groove 30.

Figure 5:
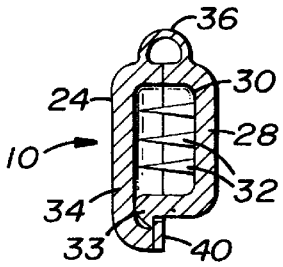
FIG. 5 is an end view of the first connector member with the housing shown in a closed position.

In FIG. 5, another end view of the first connector member 24 is shown with the housing cover 34 folded onto the top of the housing 28. In this view, the latch 40 is engaged by the pawl 33 for holding the housing 28 in a closed position. The end 12 of the lanyard 16 is not shown in FIGS. 2, 4 and 5.

Figure 6:
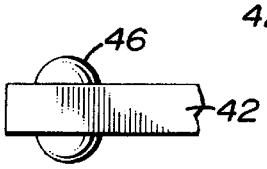
FIG. 6 is an enlarged side view of the first ball arm and first ball mounted thereon with the first ball enlarged in size.

In FIG. 6, an enlarged side view of the first ball 46 and a portion of first ball arm 42 are shown. In this drawing, a greater portion of the first ball 46 or it has in effect a greater diameter for extending outwardly from opposite sides of the first ball arm 42. The sides of the first ball arm 42 are used for receipt in a hole in a channel of the second connector member 26.

Figure 7:
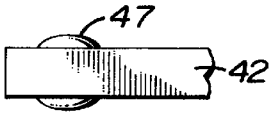
FIG. 7 is an enlarged side view of the first ball arm similar to FIG. 6, but having a flattened first ball to provide less friction when the two connector members are disengaged from each other.

In FIG. 7, an enlarged side view of another embodiment of the first ball arm 42 is shown and is similar to FIG. 6. In this drawing, a flatten ball 47 extends outwardly from the opposite sides of the first ball arm 42. The flattened ball 47 provides for less friction, when received in the hole in the channel of the second connector member 26, and quicker release when tension is applied to the lanyard 16 and the two connector members 24 and 26 are disengaged from each other. The object of the quick release of the breakaway connector 10 is to prevent an injury to the neck 22 of the user.

Figure 8:
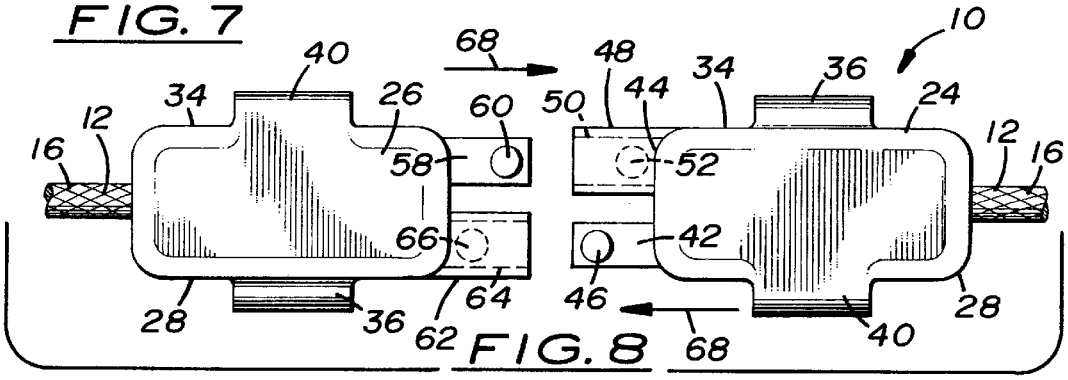
FIG. 8 is a top view on the first connector member and the second connector member. The first ball arm is shown in position for receipt in the channel of the second socket arm. The second ball arm is shown in position for receipt in the channel of the first socket arm.

In FIG. 8, a top view on the subject breakaway connector 10 is shown with the first connector member 24 positioned for connection to the second connector member 26. The two connector members 24 and 26 are shown in a closed position with the opposite ends 12 and 14 of the lanyard 16 attached thereto and extending outwardly therefrom. The second connector member 26 also includes a housing 28 with a housing cover 34 received thereon. The second connector member 26 also includes a second ball arm 58 which extends outwardly from one end 44 of the housing 28. The second ball arm 58 includes a second ball 60 mounted on the end thereof. Also, a second socket arm 62 extends outwardly from the end 44 of the housing 28. The second socket arm 62 is parallel to the second ball arm 58 and includes a channel 64 therein and a hole 66 for releasably receiving the first ball 46 therein. The channel 64 is shown in dotted lines.

In this drawing, the two connector members 24 and 26 are shown in position for releasable engagement as indicated by arrows 68. The first ball arm 42 is positioned for insertion into the channel 64 of the second socket arm 62 with the first ball 46 to be received in releasable engagement in the hole 66. Likewise, the second ball arm 58 is positioned for insertion into the channel 50 of the first socket arm 48 with the second ball 60 to be received in releasable engagement in the hole 52. As mentioned above, the two connectors members 24 and 26 are identical in structure for simplicity in manufacturing and inventory. But, it can be appreciated that the first connector member 24 could have a first ball arm 42 without the first socket arm 48. Also, the second connector member 26 could have the second socket arm 62 without the second ball arm 58. The second socket arm 62 engaging the first ball arm 42 in releasable engagement. With this type of structure, the subject breakaway connector 10 would work in a similar manner as described above and without departing from the spirit and scope of the invention. Also, it should be mentioned that the first and second balls 46 and 48 may be removable from the ball arms and different sizes and shapes. Further, the connector members 24 and 26 are designed to release when pressure in a range of 5 pounds is placed on the lanyard 16 to prevent injury to the user. Obviously the range of 5 pounds may vary depending on the size, age and strength of the user and what range in pound force might be required to avoid injury.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

What is claimed is:

1. A lanyard breakaway connector used for mounting on one end and an opposite end of a lanyard, the lanyard received around a neck of a user, the breakaway connector comprising:

a first connector member having a first housing with gripping means therein and adapted for engaging and holding the one end of the lanyard inside said first housing;

a first ball arm with a first ball attached thereto, said first ball arm extending outwardly from an end of said first housing;

a second connector member having a second housing with gripping means therein and adapted for engaging and holding the opposite end of the lanyard inside said second housing; and a second socket arm with a channel and a hole therein, said second socket arm attached to and extending outwardly from an end of said second housing, said second socket arm adapted for receiving said first ball arm therein in releasable engagement;

wherein a portion of said first ball extends upwardly from a top portion of said first ball arm and downwardly from a bottom portion of said first ball arm, said first ball adapted for receipt in the hole in the channel of said second socket arm.

2. The connector as described in claim 1 wherein said gripping means in said first and second housings is a plurality of upwardly extending spikes in said first and second housings for engaging the ends of the lanyard.

3. The connector as described in claim 2 wherein said first and second housings includes a groove therein with said spikes extending upwardly therefrom, said first and second housings further including a hinged housing cover with a latch for covering said groove and said spikes therein.

4. A lanyard breakaway connector used for mounting on one end and an opposite end of a lanyard, the lanyard received around a neck of a user, the breakaway connector comprising:

a first connector member having an enclosed first housing with gripping means therein and adapted for engaging and holding the one end of the lanyard inside said first housing;

a first ball arm with a first ball mounted on an end of said first ball arm, said first ball arm extending outwardly from an end of said first housing;

a first socket arm with a channel and a hole therein, said first socket arm attached to and extending outwardly from an end of said first housing, said first socket arm parallel to said first ball arm;

a second connector member having an enclosed second housing with gripping means therein and adapted for engaging and holding the opposite end of the lanyard inside said second housing;

a second ball arm with a second ball mounted on an end of said second ball arm, said second ball arm extending outwardly from an end of said second housing; and a second socket arm with a channel and a hole therein, said second socket arm attached to and extending outwardly from an end of said second housing, said second socket arm parallel to said second ball arm, said second socket arm adapted for receiving said first ball arm therein with said first ball received in the hole in the channel of said second socket arm in releasable engagement, said first socket arm adapted for receiving said second ball arm therein with said second ball received in the hole in the channel of said first socket arm in releasable engagement;

wherein a portion of said first ball and said second ball extend upwardly from a top portion of said first ball arm and said second ball arm and downwardly from a bottom portion of said first ball arm and said second ball arm, said first ball adapted for receipt in the hole in the channel of said second socket arm and said second ball adapted for receipt in the hole in the channel of said first socket arm, said first ball and said second ball being the same size and shape.

5. The connector as described in claim 4 wherein said gripping means in said first and second housings is a plurality of upwardly extending spikes in said first and second housings for engaging the ends of the lanyard.

6. The connector as described in claim 5 wherein said first and second housings includes a groove therein with said spikes extending upwardly therefrom, said first and second housings further including a hinged housing cover with a latch for covering said groove and said spikes therein.

7. A lanyard breakaway connector used for mounting on one end and an opposite end of a lanyard, the lanyard received around a neck of a user, the breakaway connector comprising:

a first connector member having an enclosed first housing with a plurality of upwardly extending spikes in said first housing for engaging and holding the one end of the lanyard inside said first housing;

a first ball arm with a first ball mounted on an end of said first ball arm, said first ball arm extending outwardly from an end of said first housing;

a first socket arm with a channel and a hole therein, said first socket arm attached to and extending outwardly from an end of said first housing, said first socket arm parallel to said first ball arm;

a second connector member having an enclosed second housing with a plurality of upwardly extending spikes in said second housing for engaging and holding the opposite end of the lanyard inside said second housing;

a second ball arm with a second ball mounted on an end of said second ball arm, said second ball arm extending outwardly from an end of said second housing; and a second socket arm with a channel and a hole therein, said second socket arm attached to and extending outwardly from an end of said second housing, said second socket arm parallel to said second ball arm, said second socket arm adapted for receiving said first ball arm therein with said first ball received in the hole in the channel of said second socket arm in releasable engagement, said first socket arm adapted for receiving said second ball arm therein with said second ball received in the hole in the channel of said first socket arm in releasable engagement;

wherein a portion of said first ball and said second ball extend upwardly from a top portion of said first ball arm and said second ball arm and downwardly from a bottom portion of said first ball arm and said second ball arm, said first ball adapted for receipt in the hole in the channel of said second socket arm and said second ball adapted for receipt in the hole in the channel of said first socket arm, said first ball and said second ball being the same size and shape.

8. The connector as described in claim 7 wherein said first and second housings includes a groove therein with said spikes extending upwardly therefrom, said first and second housings further including a hinged housing cover with a latch for covering said groove and said spikes therein.

* * * * *